US010380818B2

(12) United States Patent
Mugica et al.

(10) Patent No.: US 10,380,818 B2
(45) Date of Patent: Aug. 13, 2019

(54) ENHANCED TECHNOLOGY OF TOUCH-SENSITIVE INPUT PERIPHERALS FOR VOTER DATA ENTRY IN ELECTRONIC VOTING SYSTEMS

(71) Applicant: SMARTMATIC INTERNATIONAL CORPORATION, St. Michael (BB)

(72) Inventors: Antonio Jose Mugica, London (GB); Roger Piñate, London (GB); Eduardo Manuel Correia, Panama (PA)

(73) Assignee: SMARTMATIC INTERNATIONAL CORPORATION, St. Michael (BB)

( * ) Notice: Subject to any disclaimer, the term of this patent is extended or adjusted under 35 U.S.C. 154(b) by 1308 days.

(21) Appl. No.: 13/891,478

(22) Filed: May 10, 2013

(65) Prior Publication Data

US 2014/0337108 A1 Nov. 13, 2014

(51) Int. Cl.

| | |
|---|---|
| ***G07C 13/00*** | (2006.01) |
| ***H01H 13/702*** | (2006.01) |
| ***H01H 13/79*** | (2006.01) |

(52) U.S. Cl.

CPC ..... *G07C 13/00* (2013.01); *H01H 13/79* (2013.01); *H01H 2207/04* (2013.01); *H01H 2211/022* (2013.01); *H01H 2217/018* (2013.01); *H01H 2217/032* (2013.01)

(58) Field of Classification Search

CPC .... G07C 13/00; H01H 13/79; H01H 2207/04; H01H 2217/032; H01H 2217/018; H01H 2211/022

See application file for complete search history.

(56) References Cited

U.S. PATENT DOCUMENTS

| | | | | |
|---|---|---|---|---|
| 4,639,559 | A * | 1/1987 | Taguchi | H01H 13/702 200/5 A |
| 7,537,159 | B2 | 5/2009 | Mugica et al. | |
| 2001/0042005 | A1* | 11/2001 | McClure | G07C 13/00 705/12 |
| 2004/0169077 | A1* | 9/2004 | Petersen | G07C 13/00 235/386 |
| 2004/0217168 | A1* | 11/2004 | Cummings | G07C 13/00 235/386 |
| 2005/0218225 | A1* | 10/2005 | Johnson | G07C 13/00 235/386 |

(Continued)

*Primary Examiner* — Andrew Sasinowski
(74) *Attorney, Agent, or Firm* — Oliff PLC

(57) ABSTRACT

The invention consists of a new technology of grid design applicable to data entry electronic membranes or "electronic pads", said design comprised of touch-sensitive sections having augmented areas, such areas being considerably larger than what has been usual in the prior art; thus when an electronic pad employing this technology connects to a voting machine, it becomes a convenient data entry peripheral for entering voting selections, depicting the available electoral options which are pre-printed on a paper sheet or template overlaying the membranes, thus mimicking a traditional voting means based on a paper ballot, and where the sensitive areas are ample enough, easy to press upon with a finger; and when any one touch-sensitive area corresponding to a preferred candidate or option is pressed, an adjacent LED indicator unique per each option is turned on, confirming the selection just made and guaranteeing high accuracy.

6 Claims, 15 Drawing Sheets

(56) References Cited

U.S. PATENT DOCUMENTS

| | | | | |
|---|---|---|---|---|
| 2006/0196938 | A1* | 9/2006 | Van Wijk | G07C 13/00 235/386 |
| 2007/0007340 | A1* | 1/2007 | Mugica | G07C 13/00 235/386 |
| 2007/0170253 | A1* | 7/2007 | Chung | G06K 7/10346 235/386 |
| 2008/0174061 | A1* | 7/2008 | Kurita | B65H 45/20 270/45 |
| 2009/0072031 | A1* | 3/2009 | Cardone | G07C 13/00 235/386 |
| 2010/0017274 | A1* | 1/2010 | Liesenfelt | G07C 13/00 705/12 |
| 2010/0020534 | A1* | 1/2010 | Isoda | F24C 7/086 362/97.1 |
| 2012/0013489 | A1* | 1/2012 | Earl | G06F 1/1626 341/23 |
| 2013/0052039 | A1* | 2/2013 | Blaser | F04D 15/00 417/12 |
| 2014/0009215 | A1* | 1/2014 | Prest | G06F 3/044 327/517 |

* cited by examiner

ENHANCED TECHNOLOGY OF TOUCH-SENSITIVE INPUT PERIPHERALS FOR VOTER DATA ENTRY IN ELECTRONIC VOTING SYSTEMS

CROSS-REFERENCES TO RELATED APPLICATIONS (IF ANY)

None

STATEMENT AS TO RIGHTS TO INVENTIONS MADE UNDER FEDERALLY-SPONSORED RESEARCH AND DEVELOPMENT (IF ANY)

None

BACKGROUND OF INVENTION

Field of the Invention

The current invention relates to a new technology developed in order to augment the accuracy and usability of a family of electronic data entry devices, with specific emphasis toward input devices employed to register electronic votes cast by individuals in electoral processes, namely, during an actual voting session in an Election Day; but nonetheless having many potential applications in the field of devices dedicated to data entry or, more generally, to any touch-sensitive devices that accept input from human beings.

Background

All direct recording electronic voting machines incorporate a data entry means of some type, such as buttons, tactile surfaces or membranes, touch screens, et cetera. In particular, touch screen technology has advanced to a high degree, making the existence of a plurality of novel devices possible, such as all-in-one computers, PDAs, smart phones, tablet computers, hand-held game consoles, etc. Electronic keypads have been ubiquitous for more than half a century now, having found their way into commonplace devices such as calculators, remote controls, push-button telephones, command module panels in all sorts of machinery, including vehicles such as automobiles, vessels and aircraft; and in security devices such as combination locks and digital door locks.

When it comes to the economic factors that go into the design of electronic voting machines however, quite often the differences in costs between the data entry alternatives of touch screens vs. tactile surfaces or pads are considerable, especially in the case of highly populated countries where the numbers of voting devices to be deployed must suffice for millions of voters to be served during the span of a few hours in a single day.

Many countries routinely schedule elections that are carried on in a nation-wide scale, rather than at the county level or state level, with the effect that the number of candidates, parties, and available posts in a contest may require large touch screens or surfaces populated with a plurality of buttons to accommodate them conveniently and in sufficient detail. Some implementations have opted in favor of tactile surfaces, with the result that often a significant portion of the body or exposed appearance of an electronic voting machine which is visible to the voting public is comprised of one or more data entry "pads" or "surfaces" which is or are an integral part of said voting machine, bestowing it with an impressive size and appearance. An alternative type of solution consists of attaching one or more external data entry electronic pads as peripherals to a voting machine, where the firmware of the pad(s) "handshakes" and interacts with the resident software in the voting machine, consistently behaving and operating as a single, unique system to the users, namely, the voters and poll workers alike.

The inventors have previously devised one of these apparatuses, sometimes called "electronic ballots", but more formally called "ELECTRONIC VOTING PAD INPUT DEVICES", which has succeeded commercially in several elections and which has been patented in several countries (U.S. Pat. No. 7,537,159, Philippines Patent No. 1-2006-000337, Mexico Patent No. 268491, Argentina Patent No. AR053952B1).

The voting act usually requires that the voter examines the layout of available electoral options for a given election in a given location, such as a state or county, options which are typically visible in the electronic pad itself, by means of a paper ballot overlay which is affixed onto it, where customized candidate and election data having been previously printed for a specific voting process and location, down to the precinct level, thus mimicking a traditional paper ballot of old, as mentioned above. Upon identifying his/her preferred electoral options, the voter then applies a finger and presses on a spot conveniently located next or above the textual and/or graphical representation of said options running in the current election. Naturally, such options in the ballot follow designs which must have been previously agreed upon by all contenders and by the applicable electoral authority, and are comprised by informative texts and/or images, having the faces and names of candidates, with the possible addition of the emblems and/or colors of their respective political parties, or of a regional fraction thereof, or of an alliance, and the corresponding offices to be elected in the applicable contests.

When a citizen performs the act of actual voting, the voting machine registers the voting data, that is, the selected options made by the voter, in an encrypted format, and also the machine may print a receipt or VVPAT (Voter-Verified Paper Audit Trail) to allow for later verification and audit of the votes. During the whole Voting Day the ballot paper remains intact in the electronic pad(s) connected to a given voting machine and hence it can be used by all voters assigned to that specific voting station, machine or precinct. The main function and object of an electronic voting pad input device is to facilitate the inputting of choices by the voters using a relatively inexpensive technology while eliminating the need to pre-print a great many, even millions of ballots for a given election process, as in each precinct a single sheet of paper is repeatedly used, namely, viewed by many voters.

Experience has shown however, that a percentage or portion of the voters, especially the less savvy, the elderly, or those with and impaired vision or other disabilities, have experienced some degree of difficulty and/or confusion when it has come to actually vote. Some of such difficulties are associated with the requirement that in each instance, pressure must be applied with a finger in a very small area within the electronic voting pad surface, signaled by a small rectangle, circle or oval in the ballot template, which is located close to and besides the graphical representation of the option that the voter has decided to vote for, and corresponds to an intersection of conductors in the adjacent layer designs that constitute the electronic membrane, where electrical contact is accomplished due to the pressure exerted over that precise spot. However, it is a fact that sometimes the voter misses the precise location of those small areas or zones, not just once but repeatedly, and that the problem mostly happens when the voter lacks the mechanical ability or the proper visual focus due to any of the causes mentioned above. The present invention seeks to overcome such difficulties through a technology that offers a much greater area sensible to the touch, which makes much easier to press the selected option successfully, that is, without error, and also without any doubt.

The main object of the present invention is to provide a relevant improvement to a type of input means used in many application, especially in elections, namely, touch-sensitive pads or membranes that facilitate the act of voting proper, making the points where pressure must be applied in order to register a choice considerably larger and thus more convenient, while at the same time reducing the chances of mistakes, errors, and the risk of malfunction, with the added benefit of attaining simplicity and flexibility in ballot design.

There is still room for improvement in the art.

SUMMARY OF THE INVENTION

The current invention is a new technology of grid design applicable to data entry electronic membranes or "electronic pads". The design of the invention is comprised of touch-sensitive sections having augmented areas, such areas being considerably larger than what has been usual in the prior art.

When an electronic pad employing the current invention connects to a voting machine, it becomes a convenient data entry peripheral for entering voting selections, depicting the available electoral options which are pre-printed on a paper sheet or template overlaying the membranes.

This mimics a traditional voting means based on a paper ballot with the sensitive areas being ample enough and easy to press upon with a finger. When a voter presses the one touch-sensitive area corresponding to a preferred candidate or option, an adjacent LED indicator unique per each option is turned on, confirming the vote for the candidate or option just made and guaranteeing high accuracy.

BRIEF DESCRIPTION OF THE DRAWINGS

Without restricting the full scope of this invention, the preferred form of this invention is illustrated in the following drawings. In order to clarify the description set forth below and to facilitate a better understanding of the principles of operation in the preferred embodiment of the present invention, the accompanying figures consist of diagrams of both types of membranes, the first group belonging to the most common type which pertain to the prior-art, as well as of membranes incorporating the new technology of the present invention, in order to demonstrate its most significant improvements by comparison.

BRIEF DESCRIPTION OF THE PREFERRED EMBODIMENTS

There are a number of significant design features and improvements incorporated within the invention. The illustrations that will be henceforth be referred to, pertain to the preferred embodiment of the present invention, which consists of a data entry pad device housing touch-sensitive membranes of a new design, conceived for voting applications The current invention is a pad device that features 252 touch-sensitive positions or areas in the membrane matrix, arranged in 6 columns and 42 rows, and having 252 LED positions, shared by a pair of LEDs each (one red and one blue, for a total of 504 LEDs) where each LED position is adjacent to a touch-sensitive area. Where the LED indicators, though not a part of the technology that is the subject of the present invention, provide for program-controlled responses, lighting up either the red LED, or the blue LED, or both, the latter resulting in a purple color, are useful to confirm to the voter the selections made, and also highlight any type of conditions, depending on the application. The uniform distribution of the grid allows for a higher degree of flexibility in terms of the layout of the overlying template, namely, the voting ballot.

The membranes can form an electronic data entry device that connects to a host processor which may be an electronic voting machine, where a data entry device has a unique set of options displayed; and having the choices made by the user detected and recognized as electric impulses when any one of the pressure-sensitive fields of said device is pressed by said user in order to signal a command, provide ID information, or to cast a vote.

Figure 1:
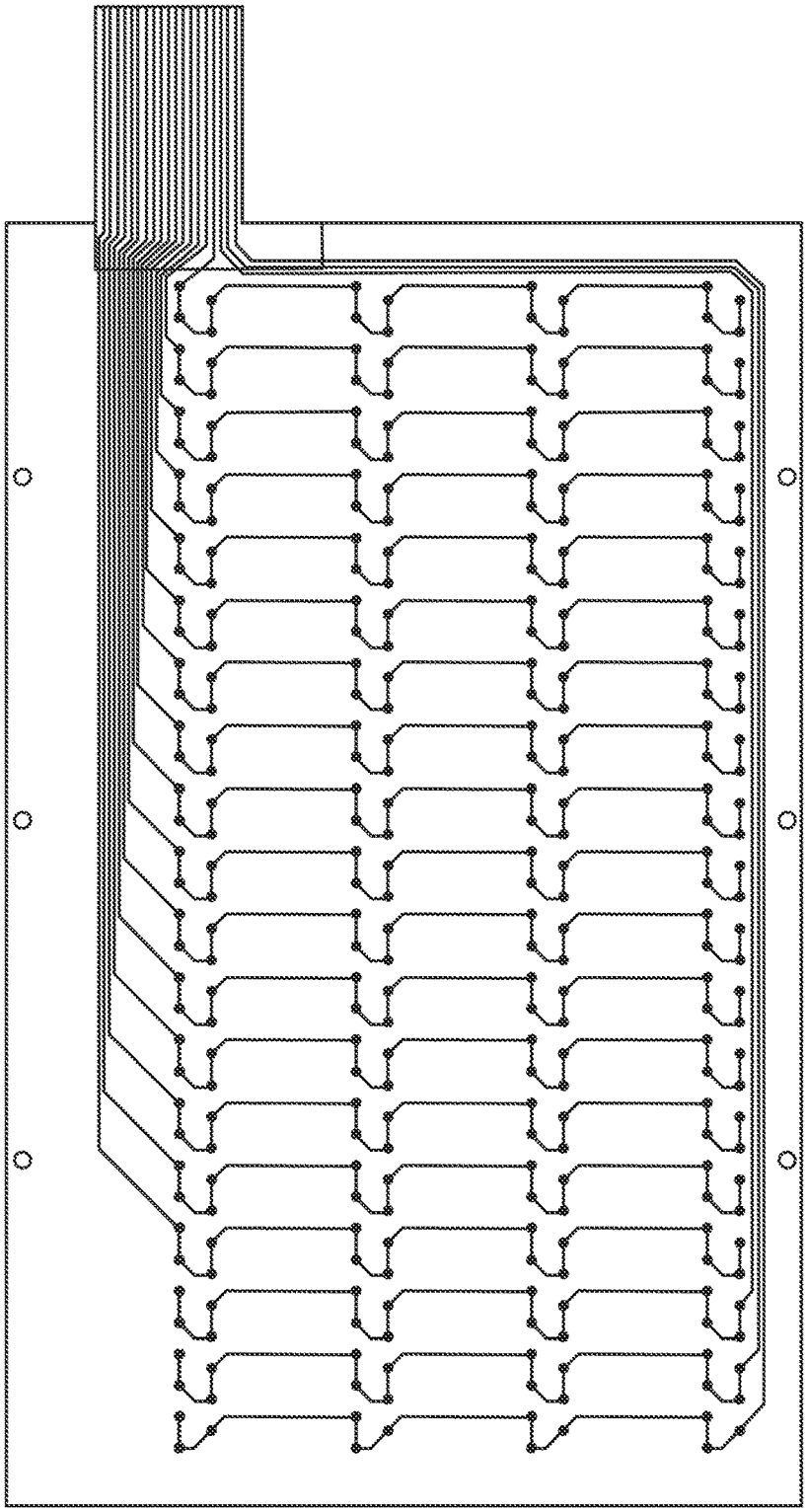
FIG. 1 PRIOR ART
FIG. 1 shows a schematic circuit in the lower layer membrane of a set of prior-art membranes in an embodiment of a touch-sensitive electronic pad device, depicting the general outlay of the conducting elements comprised in said membrane.
Figure 2:
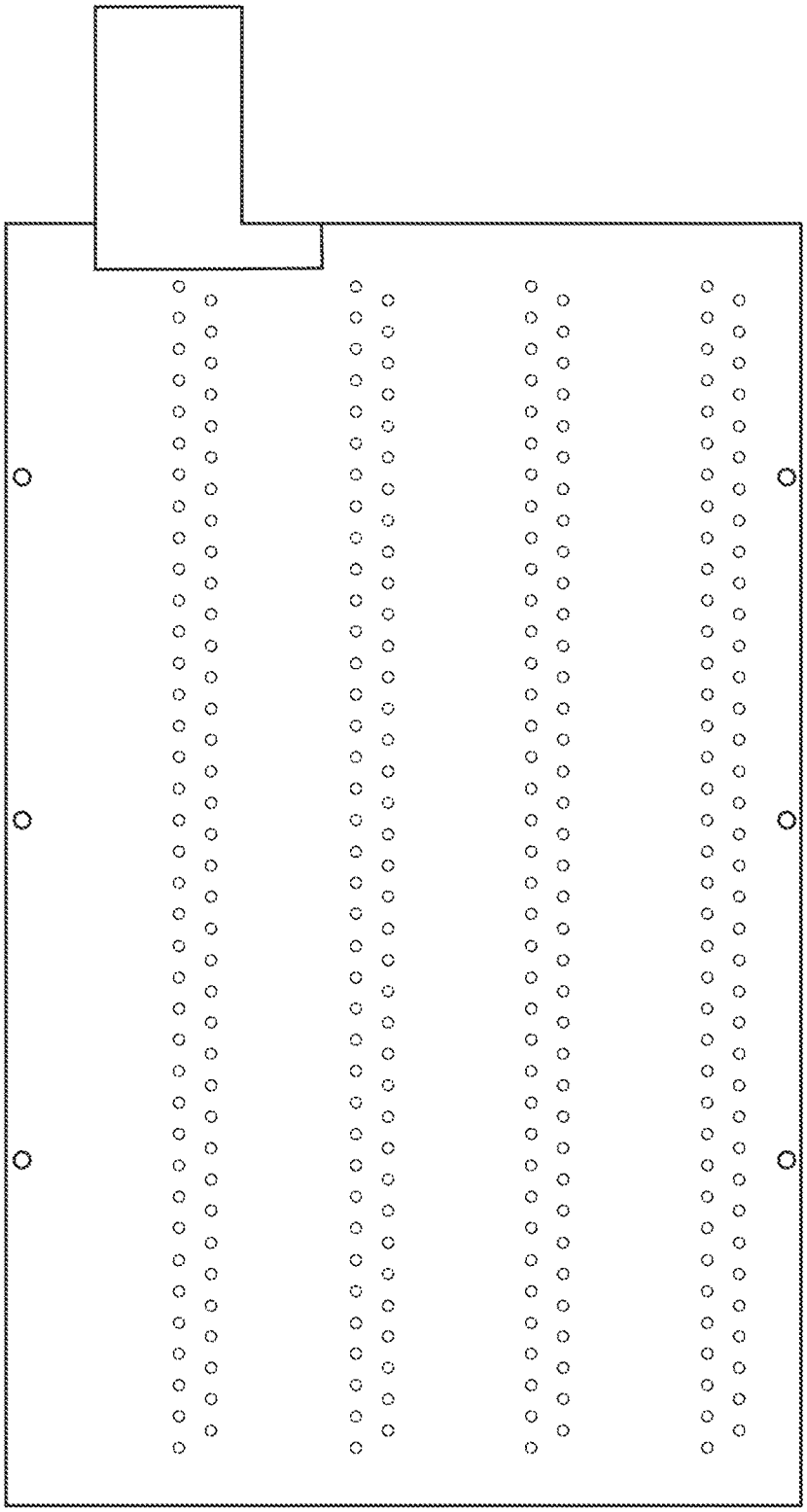
FIG. 2 PRIOR ART
FIG. 2 shows the spacer layer that separates the lower layer membrane of FIG. 1 from the upper membrane of a set of prior-art membranes in an embodiment of a touch-sensitive electronic pad device, said spacer layer having no circuits or conducting elements, and said spacer layer depicting the positions where the absence of material, namely, the holes that correspond to the points or exact touch sensitive positions allow contact between the conducting elements of said upper and lower layer membranes, when pressure is applied upon any one of those exact positions.
Figure 3:
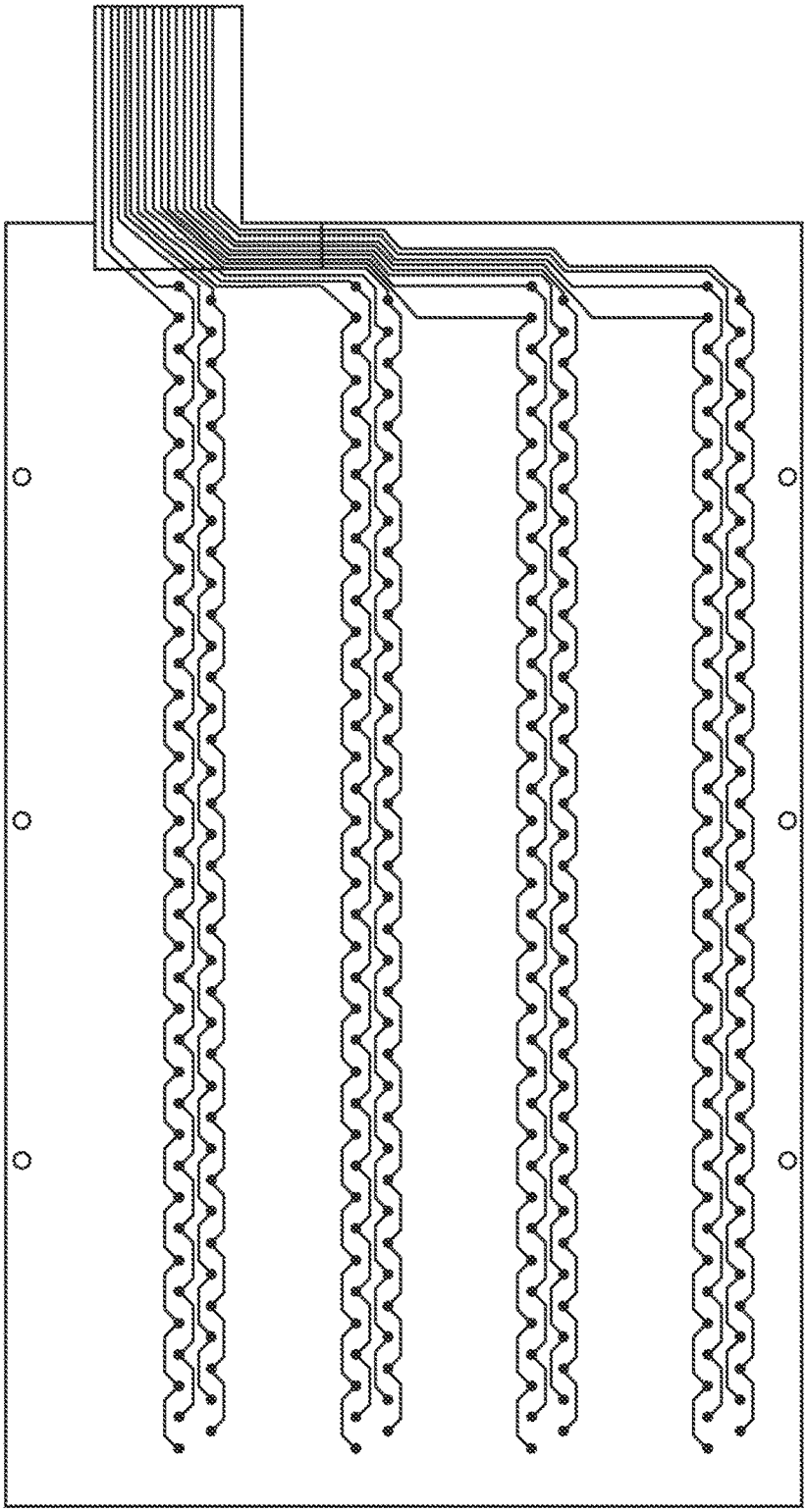
FIG. 3 PRIOR ART
FIG. 3 shows a schematic circuit in the upper layer membrane of the above set of prior-art membranes, depicting the general outlay of the conducting elements comprised in said membrane, which is assembled above the spacer layer of FIG. 2 within the enclosure of a prior-art voting pad device.
Figure 4:
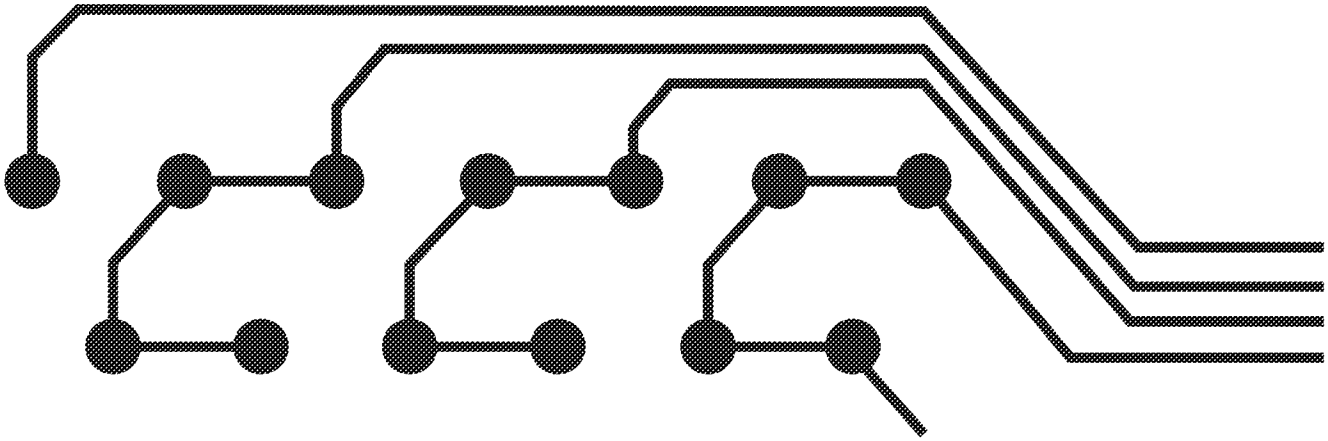
FIG. 4 PRIOR ART
FIG. 4 shows a small section of the prior-art lower layer membrane circuit of FIG. 1, showing with more detail the conducting elements.
Figure 5:
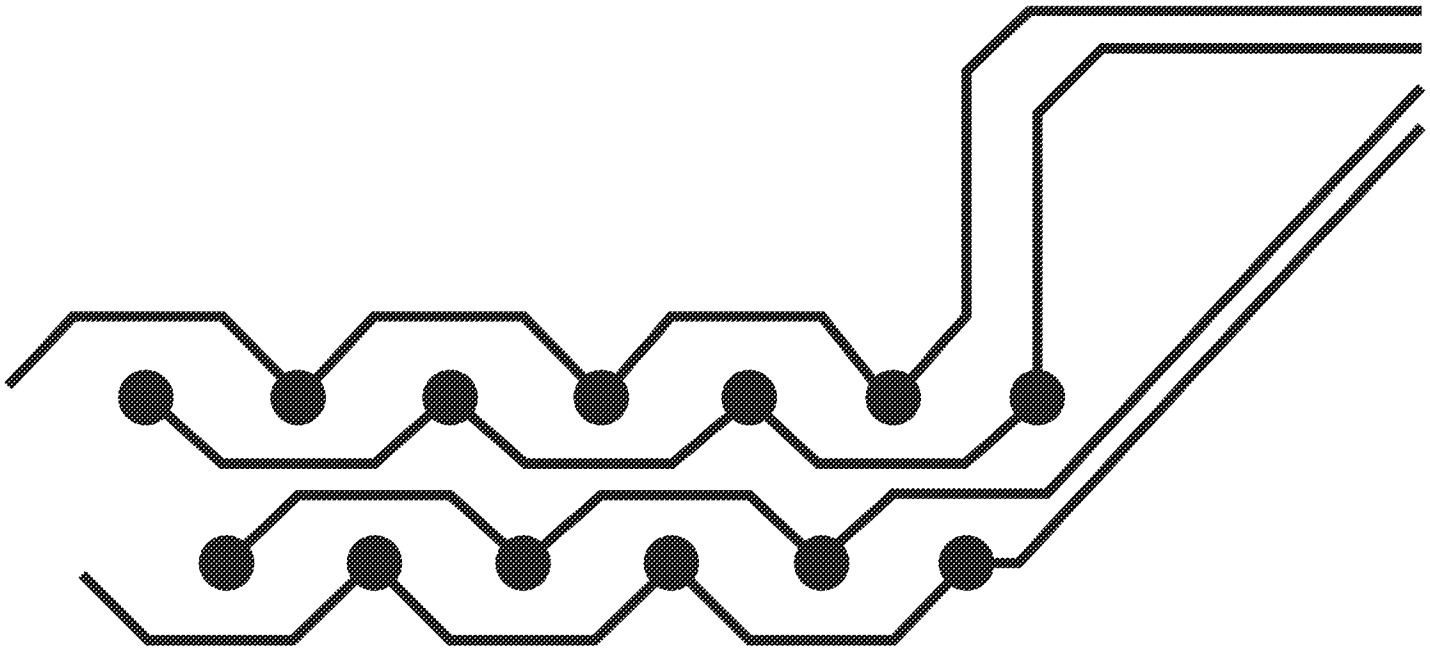
FIG. 5 PRIOR ART
FIG. 5 shows a small section of the prior-art upper layer membrane circuit of FIG. 3, likewise showing with more detail the conducting elements; and corresponding to the section of the lower layer membrane depicted in FIG. 4.
Figure 6:
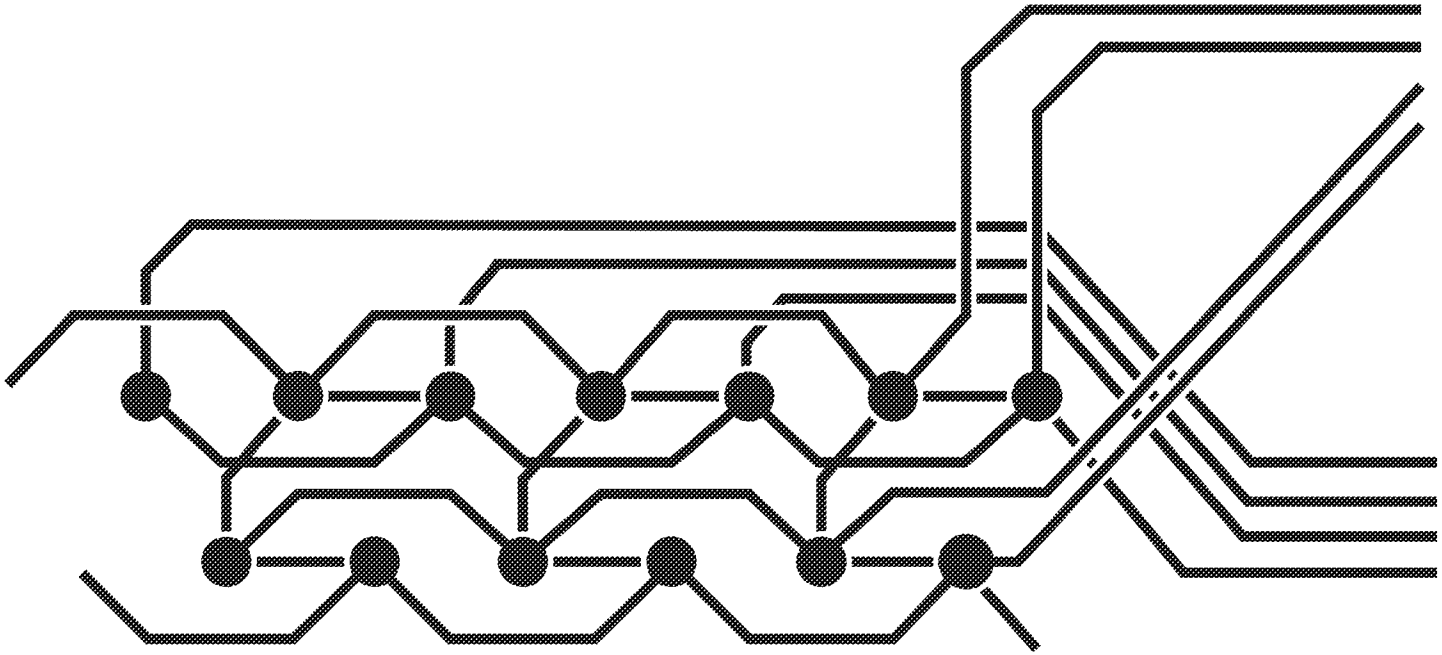
FIG. 6 PRIOR ART
FIG. 6 shows a small composite section of the schematic circuits as shown in FIGS. 4 and 5, where all three upper, spacer, and lower membranes of a prior art embodiment of a touch-sensitive electronic pad device overlap, showing in detail the points of contact between some of the corresponding conducting elements in said upper and lower layer membranes.
Figure 7:
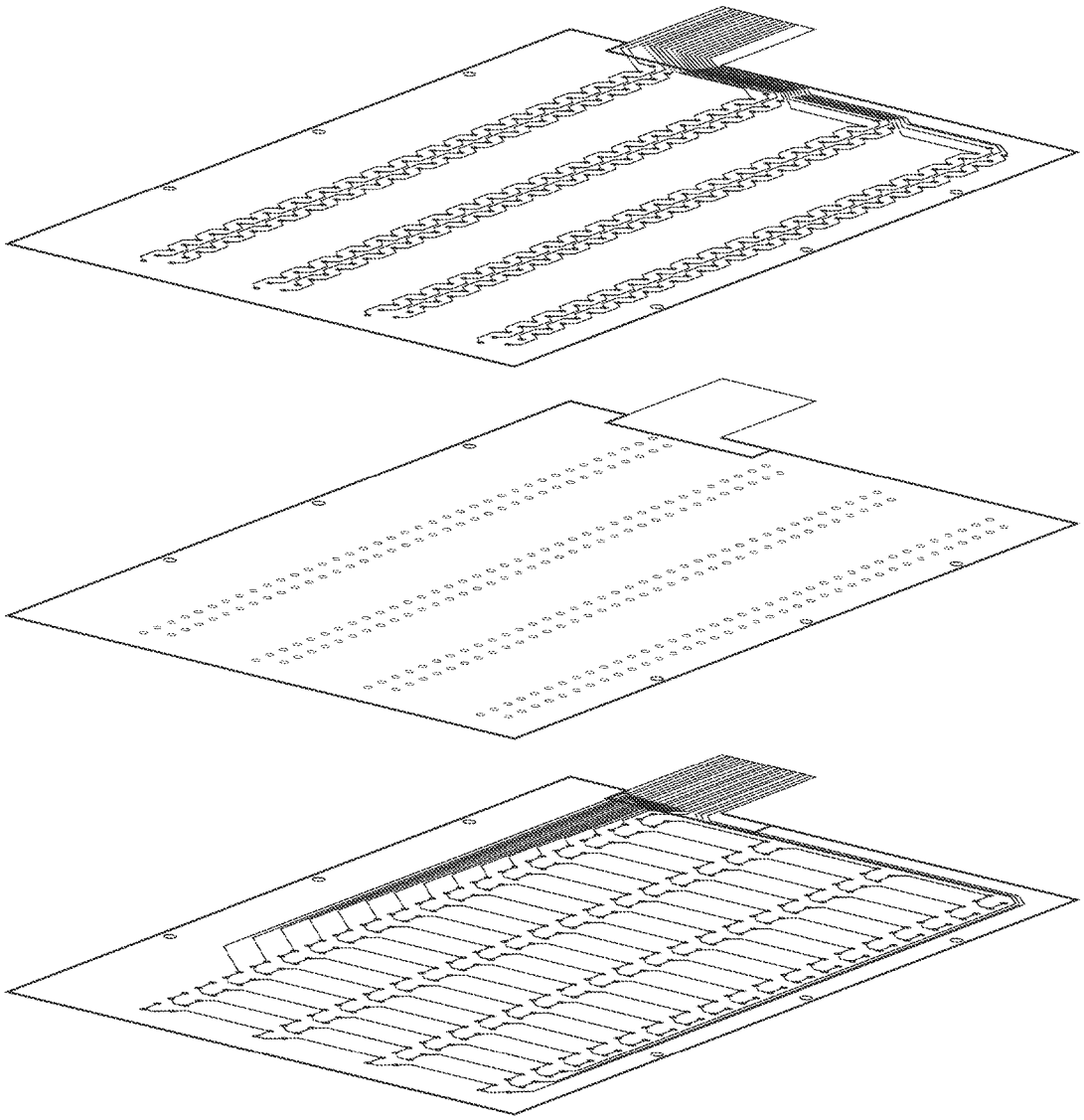
FIG. 7 PRIOR ART
FIG. 7 shows a schematic perspective of the three layers of FIGS. 1, 2, and 3, showing the way they are assembled together in a prior-art embodiment device.
Figure 8:
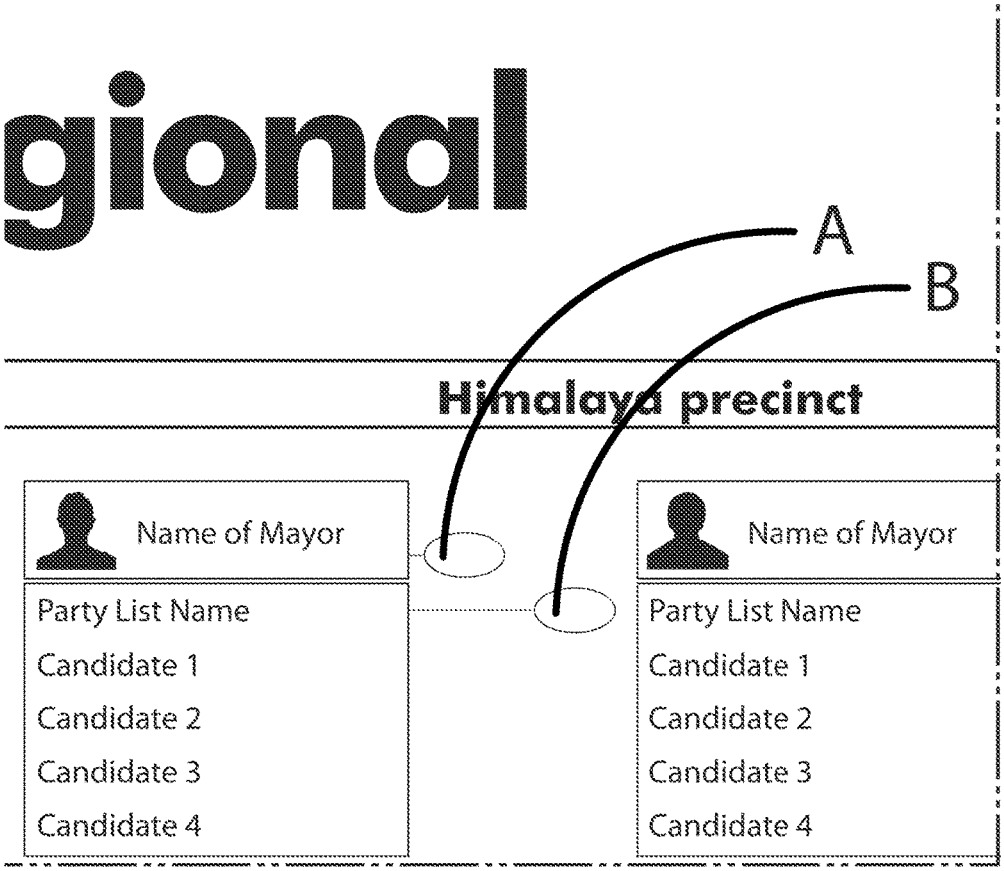
FIG. 8 PRIOR ART
FIG. 8 depicts a section of a typical prior-art ballot template design, showing the images and names of the available options in a regional election, identifying the current precinct, and offering to vote for a candidate for Mayor, for which the voter must press upon the oval A, and/or for a list of council members, for which case the voter must press upon the oval B, or both.

The Prior Art is shown in FIGS. 1 through 8. FIG. 1 displays a schematic circuit in the lower layer membrane of a set of prior-art membranes in an embodiment of a touch-sensitive electronic pad device, depicting the general outlay of the conducting elements comprised in said membrane. FIG. 2 shows a spacer layer that separates the lower layer membrane of FIG. 1 from the upper membrane of a set of prior-art membranes in an embodiment of a touch-sensitive electronic pad device. FIG. 3 shows a schematic circuit in the upper layer membrane of the above set of prior-art membranes. FIG. 4 shows a small section of the prior-art lower layer membrane circuit of FIG. 1, showing more detail the conducting elements. FIG. 5 shows a small section of the prior-art upper layer membrane circuit of FIG. 3, likewise showing with more detail the conducting elements; and corresponding to the section of the lower layer membrane depicted in FIG. 4. FIG. 6 shows a small composite section of the schematic circuits as shown in FIGS. 4 and 5, where all three upper, spacer, and lower membranes of a prior art embodiment of a touch-sensitive electronic pad device overlap, showing in detail the points of contact between some of the corresponding conducting elements in said upper and lower layer membranes. FIG. 7 shows a schematic perspective of the three layers showing the way they are assembled together in a prior-art embodiment device. FIG. 8 depicts a section of a typical prior-art ballot template design.

In its preferred embodiment, the present invention consists of three layers, two conducting layer membranes and a spacer layer that goes between them. The lower membrane 10 (FIG. 9) has strips of conductive material running on its upper side. Likewise, the upper membrane 12 (FIG. 11) has strips of conductive material on its underside whose geometric distribution is aligned with that of the lower membrane 10, precisely matching the locations of the touch-sensitive, or "contact" rectangular areas. The spacer layer 14 keeps the top and bottom membranes minutely apart so that their conductive strips do not make electrical contact, except when pressure is applied over any one of said predetermined contact areas.

Figure 9:
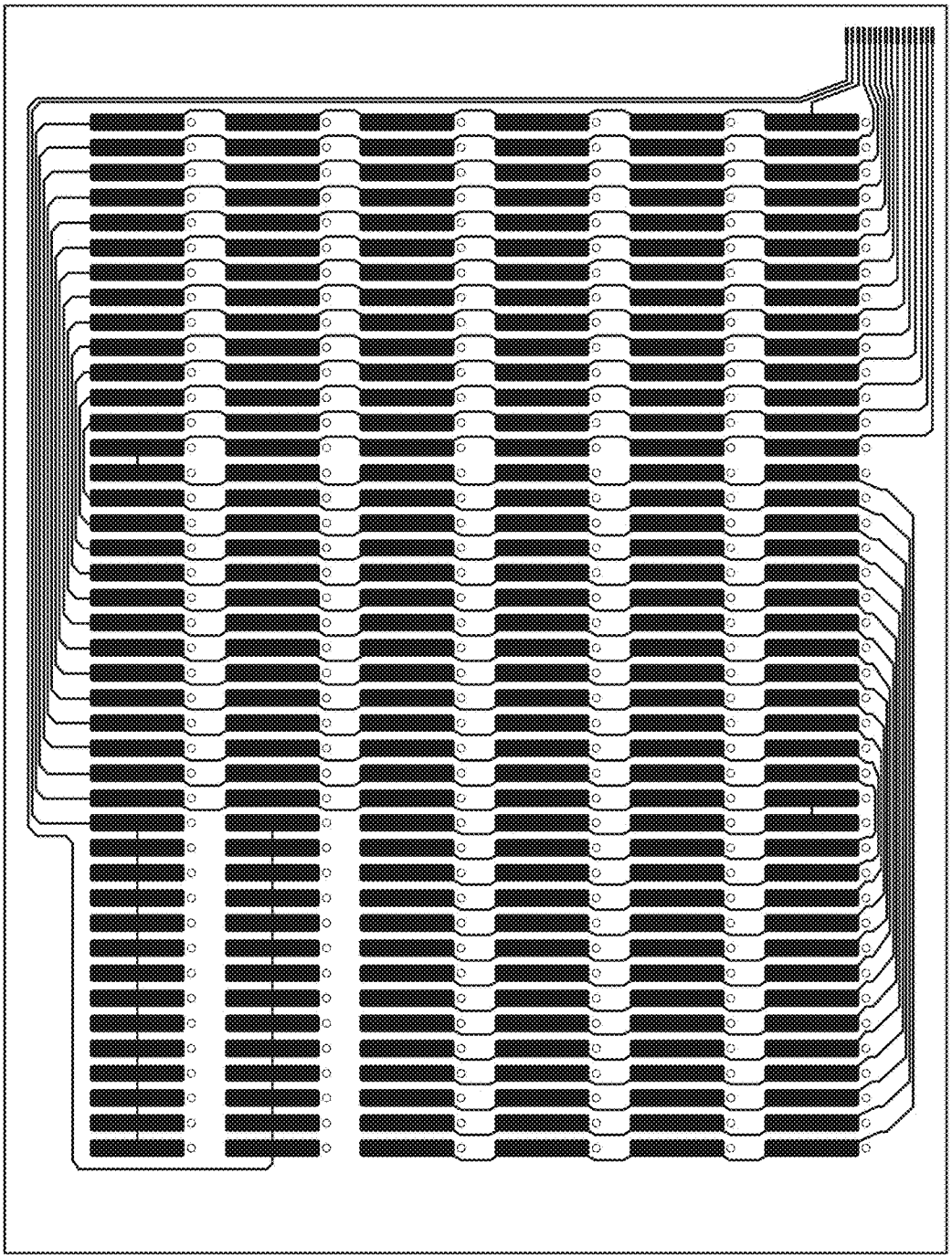
FIG. 9 shows a schematic circuit in the lower layer membrane of the present invention, depicting the general outlay of the conducting elements laid down across the whole of said membrane, which in the preferred embodiment is assembled in place together with the corresponding overlaying membranes and control circuit, within the enclosure of a voting pad device incorporating the new technology which is the object of the present invention; each rectangle corresponds to a touch-sensitive area.
Figure 10:
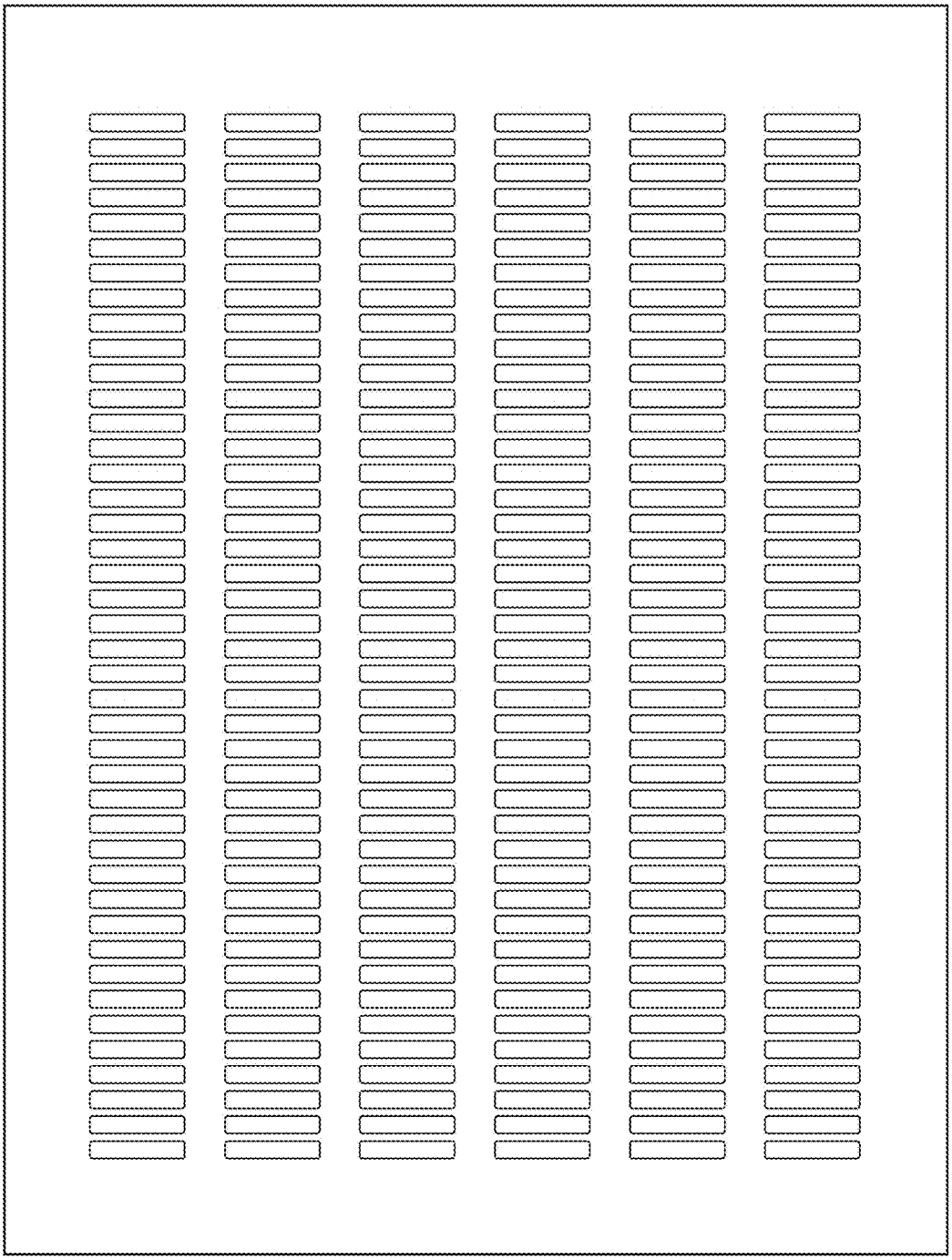
FIG. 10 shows the spacer layer that separates the lower layer membrane from the upper membrane of a set of membranes of the present invention, in an embodiment of a touch-sensitive electronic pad device, having no circuits of conducting elements, and depicting the rectangular areas or positions where the absence of material, namely, the holes that correspond to the touch-sensitive places allow contact between the conducting elements of said upper and lower layer membranes, when pressure is applied upon any one of said rectangular areas or positions.
Figure 11:
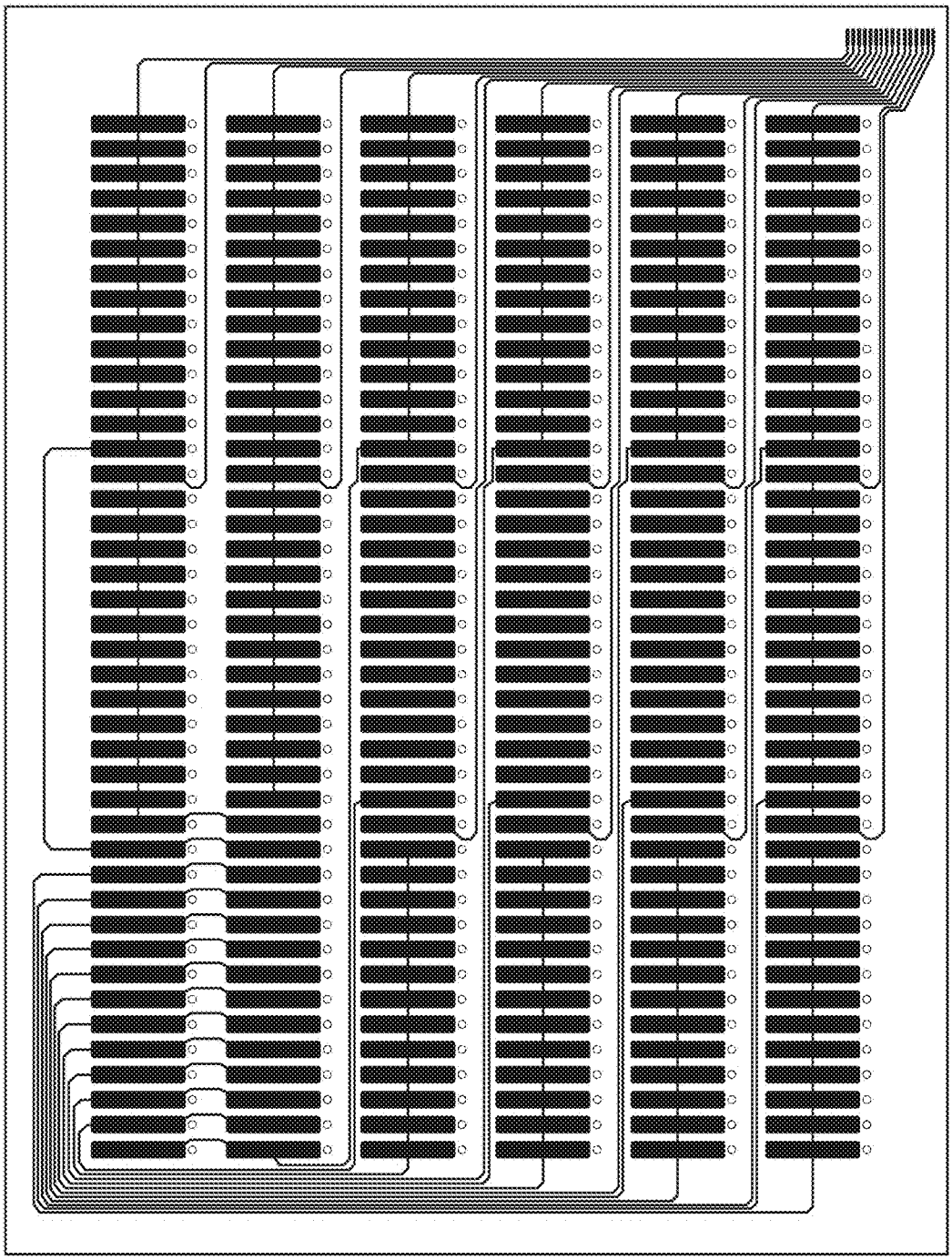
FIG. 11 shows the schematic circuit in the upper layer membrane that forms a set with a corresponding circuit in the lower membrane of FIG. 9 and the spacer layer of FIG. 10, depicting the general outlay of the conducting elements laid down across the whole of said membrane, which is placed directly above the spacer layer of FIG. 10 and assembled together with it, with the lower membrane of FIG. 9, and with the corresponding control circuit within the enclosure of a voting pad device; likewise each rectangle corresponds to a touch-sensitive area or position.

Contact areas are defined as those where the spacer layer has holes of precise shapes and locations, each of which leaves a void between the upper and lower membranes, rendering those locations sensitive to pressure and able to achieve electrical contact when touched or pressed upon. Both membranes are connected to a controller circuit which takes care of several functions such as keystroke detection (namely, detection that a circuit has been closed, and which one), submittal of scan codes to a host, execution of host-received commands, collision detection, and command retry. Such controller circuit in assembled into the enclosure that houses the membranes, and placed at the uppermost right corner as shown in FIGS. 9 and 11. The controller circuit is programmed to sense contact, namely, to detect "keystrokes", that means that a particular area or "button" is being pressed out of the hundreds of possible combinations in the unit, and to send a corresponding scan code sequence to the host processor, that is, the electronic voting machine to which the voting pad unit comprising the membranes and the controller circuit is attached.

The membrane mechanism does not provide by itself a "feel" that contact has been made, hence any feedback to the user must is provided through other means, such as lighting one of the LEDs 20 adjacent to the touch-sensitive area 30 which has been pressed upon, under the orders of the controller circuit.

Figure 12:
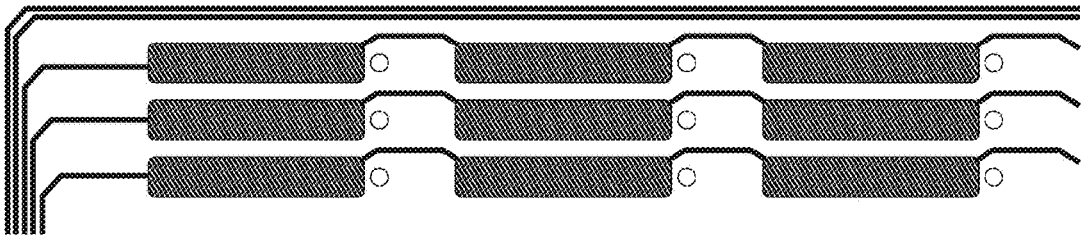
FIG. 12 shows a small section at the top left corner of the lower membrane circuit of FIG. 9, showing with more detail the conducting elements, including those within each touch-sensitive rectangle, the latter which are aligned diagonally. The small circles next to each touch-sensitive rectangle correspond to a LED indicator each.
Figure 13:
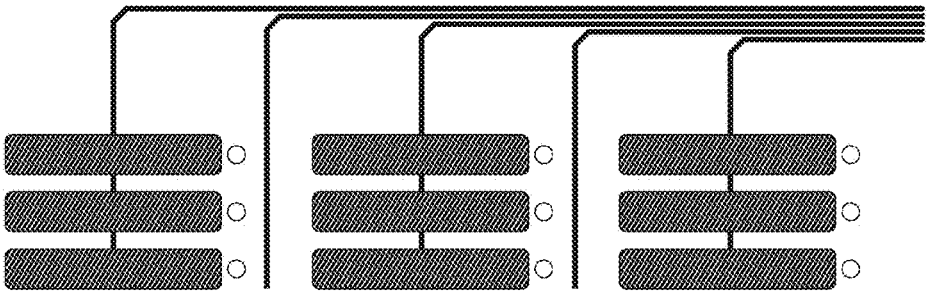
FIG. 13 shows a small section at the top left corner of the upper membrane circuit of FIG. 11, likewise showing with more detail the conducting elements, including those within each touch-sensitive rectangle, the latter which are tilted at a different angle than the conducting elements within the corresponding touch-sensitive rectangles of FIG. 12. Again, the small circles next to each touch-sensitive rectangle correspond to a LED indicator each.

FIGS. 9 and 11 shows to a membrane layers. In each of the plurality of rectangular areas sensible to the touch, those in the lower layer membrane (FIGS. 9 and 12) have a diagonal pattern and those in the upper layer membrane (FIGS. 11 and 13) have an inverse diagonal pattern.

Figure 14:
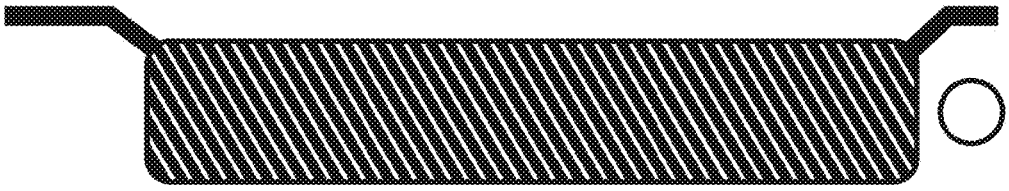
FIG. 14 shows a close-up view of a single touch-sensitive rectangle in the lower membrane of FIGS. 9 and 12, the rectangle comprised of conducting elements aligned in diagonals; the small circle next to the touch-sensitive rectangle corresponds to a LED indicator each.
Figure 15:
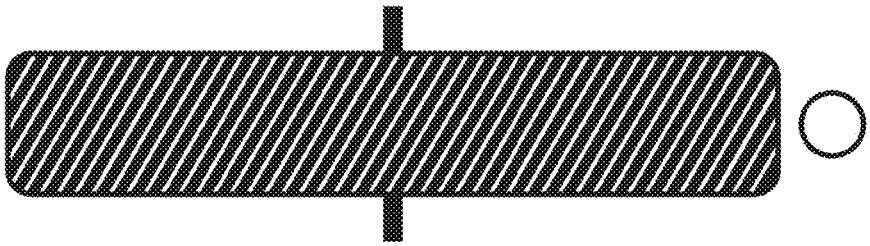
FIG. 15 shows a close-up view of a single touch-sensitive rectangle in the upper membrane of FIGS. 11 and 13, the rectangle comprised of conducting elements aligned in inverse diagonals; similarly, the small circle next to the touch-sensitive rectangle corresponds to a LED indicator
Figure 16:
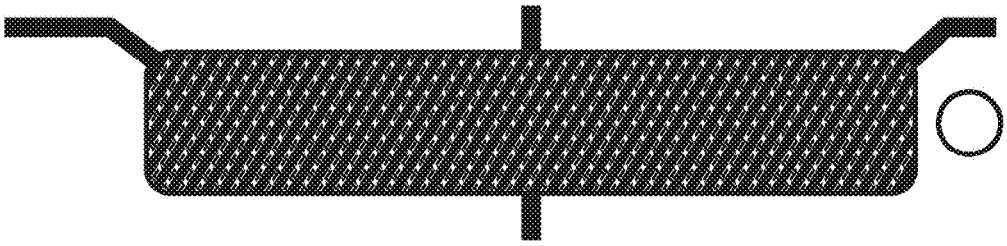
FIG. 16 shows a close-up view of one of the overlapping single touch-sensitive rectangles of the upper and lower membranes of FIGS. 14 and 15, corresponding exactly to the same matching locations within the membranes, and thus able to make contact between conducting elements of each, at any point within said rectangle.
Figure 17:
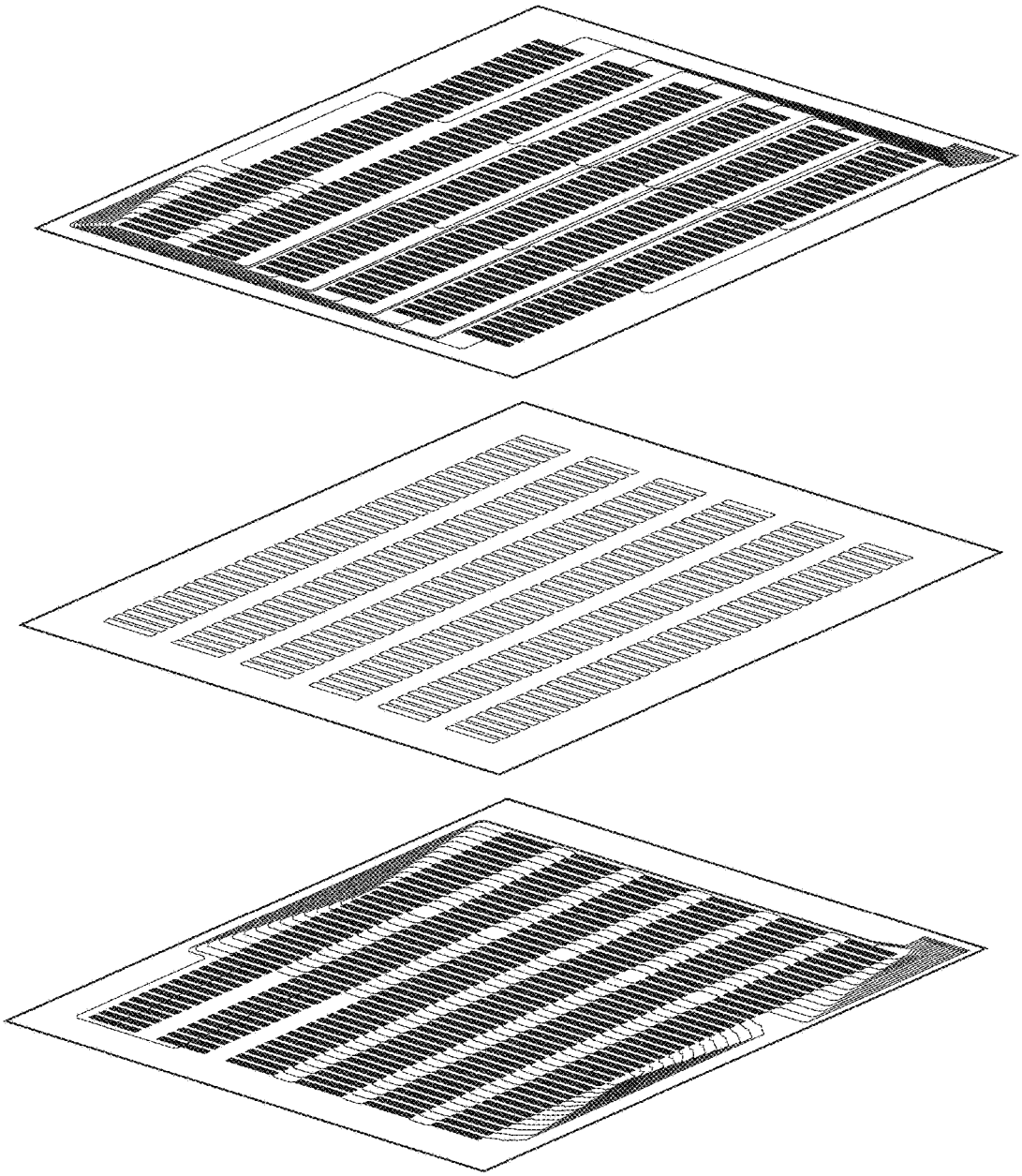
FIG. 17 shows a schematic perspective of the three layers of FIGS. 9, 10, and 11, showing the way they are assembled together in a device which is the preferred embodiment of the present invention.
Figure 18:
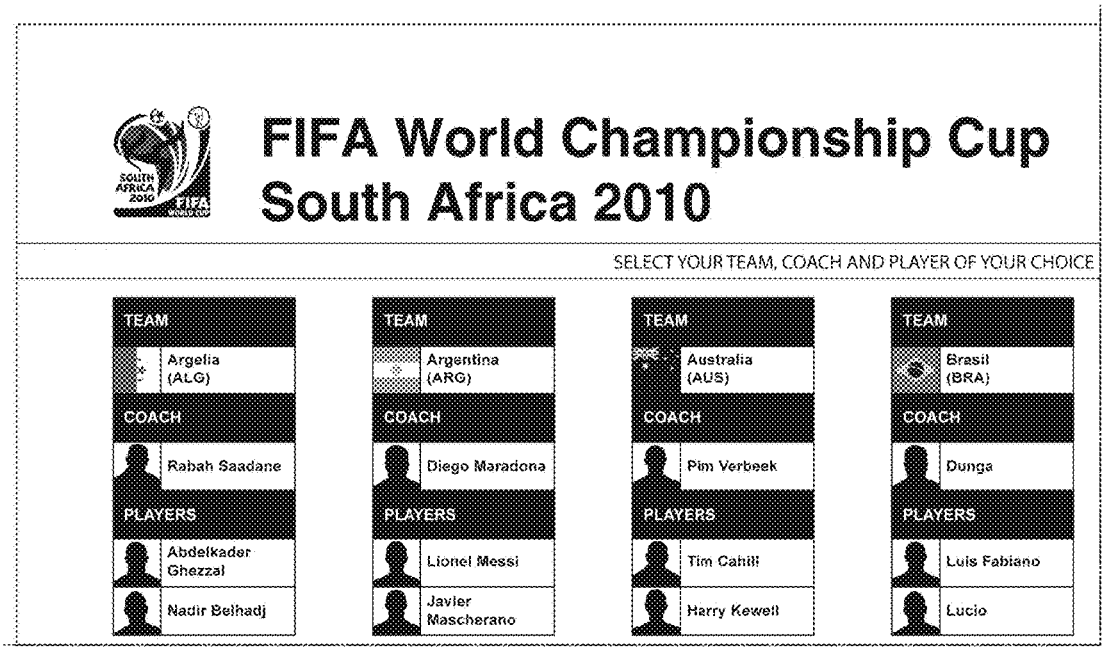
FIG. 18 depicts a section of a typical ballot template design, taking advantage of the larger areas allowed by the enhanced technology which is the object of the present invention, showing the titles of the available posts in the contest, and the names and images of candidates, so in this example the voter must press with a finger upon the name of the preferred team, and/or upon the names under the preferred available posts.

FIGS. 14 and 15 depict in closer detail the diagonal patterns of the touch-sensitive rectangular areas 30 in the lower 10 and upper membranes 12, respectively. When the two membranes are superimposed with one another, having the spacer layer between them, a crossed pattern (FIG. 16) results for each touch-sensitive rectangle 30. When a voter presses on any spot over a selected rectangular touch-sensitive 30 surface of the upper membrane 12, the pressure will make one or several of the conducting elements within that rectangle to touch any one (or more) of the many conducting elements within the matching touch-sensitive rectangle 30 in the opposite lower underlying membrane, closing the electronic circuit and generating a "touch" or "contact" signal which is detected by the control circuit to which the membranes connected to, and which in turn instantly conveys the selected option to the electronic voting machine to which the data entry device is attached.

The electoral options are displayed through a ballot. Which in the preferred embodiment is a pre-printed paper sheet or overlay is placed as part of the election management procedures prior to an election, where said ballot is made clearly visible to the voter through a transparent cover sheet during the act of voting; said ballot dearly identifying the available electoral options, whose locations correspond in a one-to-one basis to an array of touch-sensitive or pressure-sensitive fields determined by the geometry of said membranes in a data entry device, one paper sheet to a device, having a set of pre-established dimensions, on which an orderly array of electoral choices have been previously printed, providing the overall appearance of a traditional paper ballot which is repeatedly viewed and utilized by voters at the moment of voting;

As in the previous art data entry devices using membranes, the controller circuit is programmed to sense that a particular position or "button" is being pressed, out of the many possible touch-sensitive areas available, and to send a corresponding scan code sequence to the host processor, that is, the voting machine to which the data entry device is connected. Additionally, upon detecting that a contact has been made, the controller circuit immediately turns on the LED 20 adjoining the touch-sensitive area 30 which has been pressed upon, thus acknowledging that contact has been made and providing instant feedback to the user, namely, the voter.

The enhanced design consisting of the diagonal patterns of the conducting elements within the touch-sensitive rectangles 30 of augmented areas in the matching membranes, which when contact is accomplished at any given point inside a given one of said rectangles 30 it appears as if a single contact has been made identifying a single option to the accompanying technology in the electronic control circuit, represents a definite progress over traditional touch-sensitive membranes, as further disclosed in the advantages recited in the reasoning that follows.

Advantages of the Invention

In the present invention, the crossed patterns in the touch-sensitive areas provide several concrete advantages over the prior art. One advantage is that having many small contact points, both surfaces may be built to be considerable nearer to each other, thus requiring a moderate pressure to achieve contact. Another advantage is that having many independent contact points in any selectable area or rectangle makes the possibility of damage in any one contact element, or contact point, to be irrelevant, as the rest of the plurality of contacts available within the affected selectable area remain active. In this manner, even in the event of failure to make contact in one or more contact points, the selectable area keeps functioning normally, as the rest of the contact points remain sensitive to the touch. As an illustration, we might make an analogy with an LCD monitor screen, where it is regarded as normal that a few pixels become defective or "dead", however images are still clearly seen and the monitor works correctly. This is due to the vast numbers of working pixels that make the failing ones irrelevant. It is only when the density of "dead" pixels surpasses a certain threshold that the quality of images is perceptibly hindered, making the monitor to be regarded as defective.

On another count, it can be regarded as an advantage that the ballot designs are not limited to reserving single "points" as the only spots that the voter must identify unmistakably as an electoral option and press upon it with a steady hand and finger, without error; but rather have whole touch-sensitive areas of greater extent, that are easier to spot: actually, in our preferred embodiment, said areas are as large as 50 mm×9 mm. Also, such touch-sensitive areas respond more easily to the touch, as they are sensitive at any point within the whole area, a rectangle in our preferred embodiment, and give immediate acknowledgment when pressed upon, as each of their adjacent LEDs will light up when pressed, and will stay lit until when the vote has finally been confirmed and issued by the voter. This instant review mechanism gives the voter the chance to ascertain that the option selected was indeed the intended one before confirming the vote, or, in the event that the selected option was mistaken, it can still be corrected at will by either pressing upon the area corresponding to another different option, or by interacting with the voting machine and accompanying software, that is, the voting system software which is active for that specific voting machine in that particular election, and making it to enable the chance to enter another option.

The resulting and probably the most relevant advantage is that input devices incorporating this enhanced technology are able to make that the data, or decisions in the case of the user is a voter, are easily capable of attaining a hundred-percent accuracy.

As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device comprising upper and lower touch-sensitive membranes with a spacer layer therebetween, wherein:

the upper and lower membranes together form a plurality of touch-sensitive areas that each output a different signal to a controller when touched by a user;

each of the touch-sensitive areas includes a plurality of distinct contact points where conductive patterns of the upper and lower membranes are able to touch each other through the spacer layer; and for each of the plurality of touch-sensitive areas:

the conductive pattern of the lower touch-sensitive membrane is comprised of strips that extend diagonally relative to an edge of the touch-sensitive area;

the conductive pattern of the upper touch-sensitive membrane is comprised of strips that extend inversely diagonal relative to the edge; and the conductive patterns are able to touch each other when one of the upper and lower touch-sensitive membranes is touched by a finger of the user.

2. An electronic data entry device, comprising:

the device as defined in claim 1;

ad-hoc electronic circuitry; and an enclosure, wherein when one of the upper and lower touch-sensitive membranes of any one of the plurality of touch-sensitive areas is touched with the finger of the user, a contact area between the finger and the one membrane is comparable to or larger than an upper limit achievable by the finger when pressed against another flat surface.

3. The device as defined in claim 1, wherein each point where the diagonal strips of the lower and upper touch-sensitive membranes cross constitutes one of the plurality of distinct contact points.

4. The device as defined in claim 1, wherein:

the device further comprises an LED located next to a said touch-sensitive area; and when the conductive patterns touch, a confirmation signal is produced by way of the LED lighting and staying lit until other action on the device is taken.

5. The device as defined in claim 4, wherein the other action is the user touching another one of the plurality of touch-sensitive areas.

6. The device as defined in claim 1, wherein:

the spacer layer includes a plurality of holes corresponding to the plurality of touch-sensitive areas and through which the conductive patterns of the upper and lower touch-sensitive membranes come into contact; and an area of each of the plurality of holes is the same as that of the corresponding touch-sensitive area.

* * * * *